US009293805B2

(12) United States Patent
Horner et al.

(10) Patent No.: US 9,293,805 B2
(45) Date of Patent: Mar. 22, 2016

(54) TAPERED SLOT ANTENNA HEMISPHERICAL ARRAY

(71) Applicant: The United States of America as represented by the Secretary of the Navy, Washington, DC (US)

(72) Inventors: Robert S. Horner, San Diego, CA (US); Nicholas R. Gigis, Charleston, SC (US); Robert J. Motyl, Oceanside, CA (US); Hale B. Simonds, Santee, CA (US)

(73) Assignee: THE UNITED STATES OF AMERICA AS REPRESNTED BY THE SECRETARY OF THE NAVY, Washington, DC (US)

( * ) Notice: Subject to any disclaimer, the term of this patent is extended or adjusted under 35 U.S.C. 154(b) by 221 days.

(21) Appl. No.: 14/189,458

(22) Filed: Feb. 25, 2014

(65) Prior Publication Data

US 2015/0244078 A1 Aug. 27, 2015

(51) Int. Cl.

| | |
|---|---|
| ***H01Q 13/10*** | (2006.01) |
| ***H01Q 1/12*** | (2006.01) |
| ***H01Q 13/08*** | (2006.01) |
| ***H01Q 21/06*** | (2006.01) |
| ***H01Q 21/20*** | (2006.01) |

(52) U.S. Cl.

CPC ..... *H01Q 1/1242* (2013.01); *H01Q 13/085* (2013.01); *H01Q 21/064* (2013.01); *H01Q 21/205* (2013.01)

(58) Field of Classification Search

CPC ..... H01Q 1/1242; H01Q 13/10
USPC ..... 343/767, 770, 878, 879, 891–893
See application file for complete search history.

(56) References Cited

U.S. PATENT DOCUMENTS

| | | | | |
|---|---|---|---|---|
| 7,009,572 | B1 | 3/2006 | Horner et al. | |
| 7,148,855 | B1 | 12/2006 | Horner et al. | |
| 7,358,914 | B1 | 4/2008 | Horner | |
| 7,397,440 | B1 | 7/2008 | Horner et al. | |
| 7,518,565 | B1 * | 4/2009 | Horner | H01Q 13/085 343/767 |
| 7,592,962 | B1 | 9/2009 | Horner et al. | |
| 7,612,729 | B1 | 11/2009 | Horner et al. | |
| 7,679,574 | B1 | 3/2010 | Horner | |
| 7,679,575 | B1 | 3/2010 | Horner et al. | |
| 7,692,596 | B1 | 4/2010 | Horner et al. | |
| 7,701,406 | B1 | 4/2010 | Horner et al. | |
| 7,773,043 | B1 | 8/2010 | Horner et al. | |
| 7,782,265 | B1 | 8/2010 | Horner et al. | |
| 7,843,398 | B1 | 11/2010 | Horner | |
| 8,269,685 | B2 * | 9/2012 | McQuaid | H01Q 1/38 343/700 MS |

* cited by examiner

*Primary Examiner* — Khai M Nguyen
(74) *Attorney, Agent, or Firm* — SPAWAR Systems Center Pacific; Kyle Eppele; Ryan J. Friedl

(57) ABSTRACT

A system may include a base portion, first and second support members coupled to the base portion, a first plurality of tapered slot antenna (TSA) pairs coupled to the first support member, and a second plurality of TSA pairs coupled to the second support member. The first plurality TSA pairs are oriented at a non-zero angle about a first axis of the first support member and are oriented at a non-zero angle about a second axis of the first support member, with the second axis being perpendicular to the first axis. The second plurality TSA pairs are oriented at a non-zero angle about a first axis of the second support member and are oriented at a non-zero angle about a second axis of the second support member, with the second axis being perpendicular to the first axis.

20 Claims, 9 Drawing Sheets

TAPERED SLOT ANTENNA HEMISPHERICAL ARRAY

FEDERALLY-SPONSORED RESEARCH AND DEVELOPMENT

The Tapered Slot Antenna Hemispherical Array is assigned to the United States Government and is available for licensing for commercial purposes. Licensing and technical inquiries may be directed to the Office of Research and Technical Applications, Space and Naval Warfare Systems Center, Pacific, Code 72120, San Diego, Calif., 92152; voice (619) 553-5118; email ssc_pac_T2@navy.mil; reference Navy Case Number 101797.

BACKGROUND

Typical antenna arrays require at least one separate antenna or antenna set for capabilities including direction finding, acquisition, communication and information operations. Further, typical antenna arrays lack ultra-broad band frequency capabilities and high gain/directivity. A need exists for a small antenna array having the above capabilities, as well as, ultra-broad band frequency capabilities and high gain/directivity.

DETAILED DESCRIPTION OF SOME EMBODIMENTS

The embodiments of the antenna array described herein use tapered slot antenna (TSA) cylindrical arrays to provide direction finding in the hemisphere (both azimuth and elevation) of Signals of Interest (SOIs). The unique combination provides excellent direction finding accuracy within the hemisphere from 360 degrees in azimuth and up to 90 degrees in elevation. The embodiments provide the ability to detect SOI's anywhere behind, in front of, beside, or above the antenna system within a given distance depending on the sensitivity of the receivers. In addition to azimuth and elevation, the embodiments provide signal detection and location in vertical, horizontal, right circular and left circular polarizations. Accordingly, SOI's can be detected regardless of the orientation or polarization of an antenna of interest.

Figure 1:
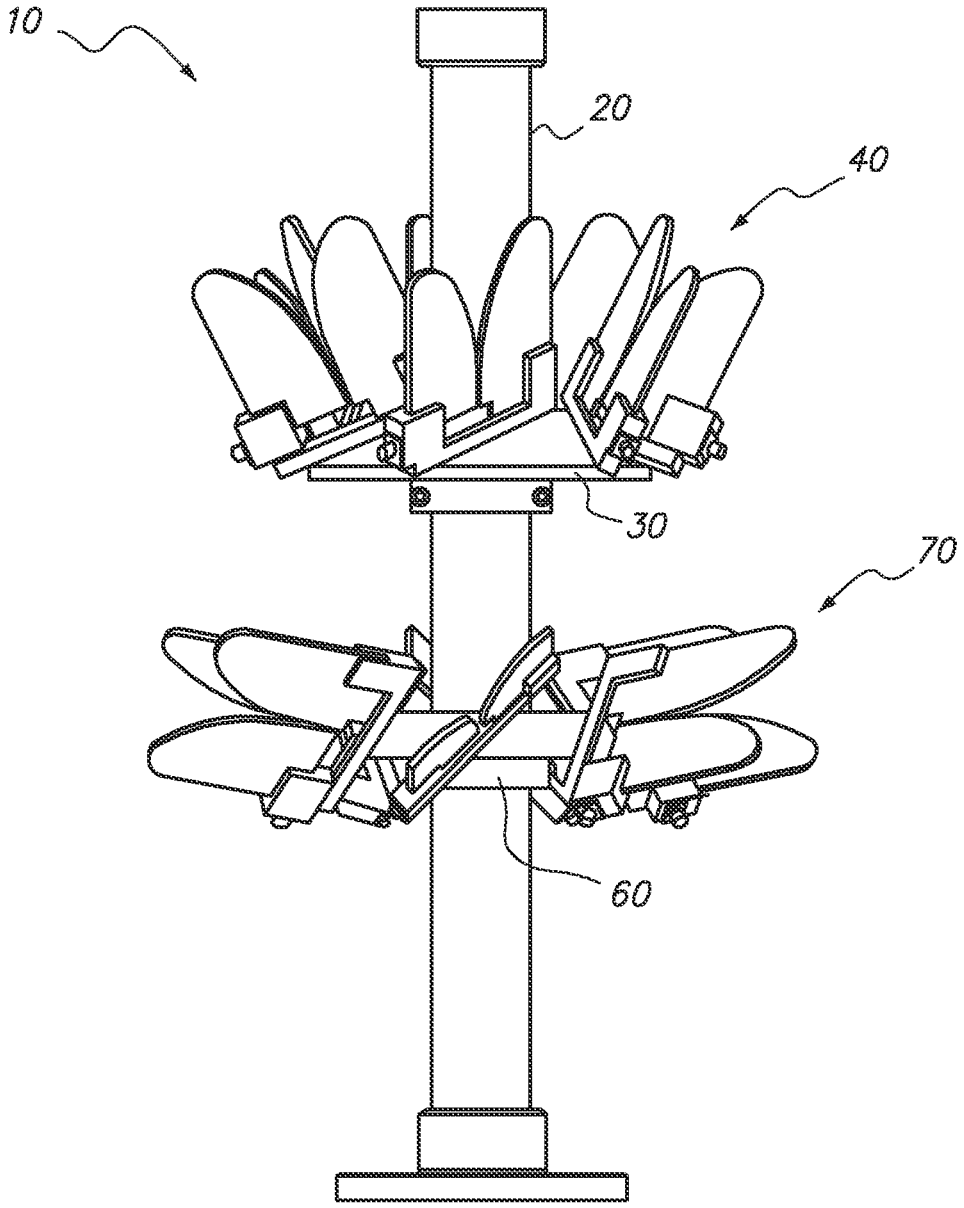
FIG. 1 shows a front view of an embodiment of a Tapered Slot Antenna Hemispherical Array having two antenna arrays.
Figure 2A:
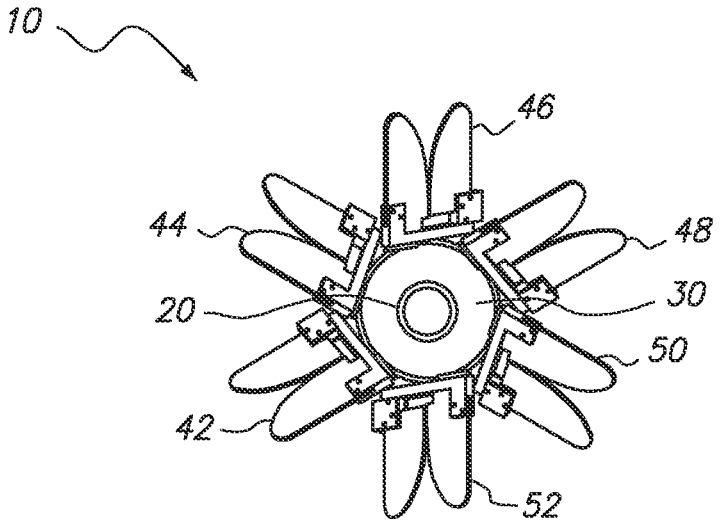
FIG. 2A shows a top view of a first array of antenna pairs of the Tapered Slot Antenna Hemispherical Array shown in FIG. 1.
Figure 2B:
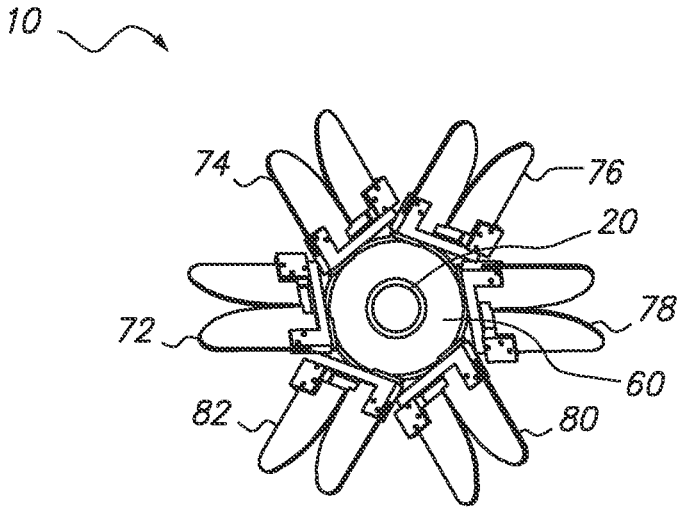
FIG. 2B shows a top view of a second array of antenna pairs of the Tapered Slot Antenna Hemispherical Array shown in FIG. 1.

Referring to FIGS. 1-2B, FIG. 1 shows a front view of an embodiment of a Tapered Slot Antenna Hemispherical Array 10, while FIG. 2A shows a top view of a first array of TSA pairs and FIG. 2B shows a top view of a second array of TSA pairs. Array 10 includes a base portion 20, a first support member 30 having a first plurality of TSA pairs 40 coupled thereto, and a second support member 60 having a second plurality of TSA pairs 70 coupled thereto. In some embodiments, TSA pairs are symmetrically coupled about their respective support member, while in other embodiments some or all of the TSA pairs may be asymmetrically coupled about their respective support member.

Figure 3:
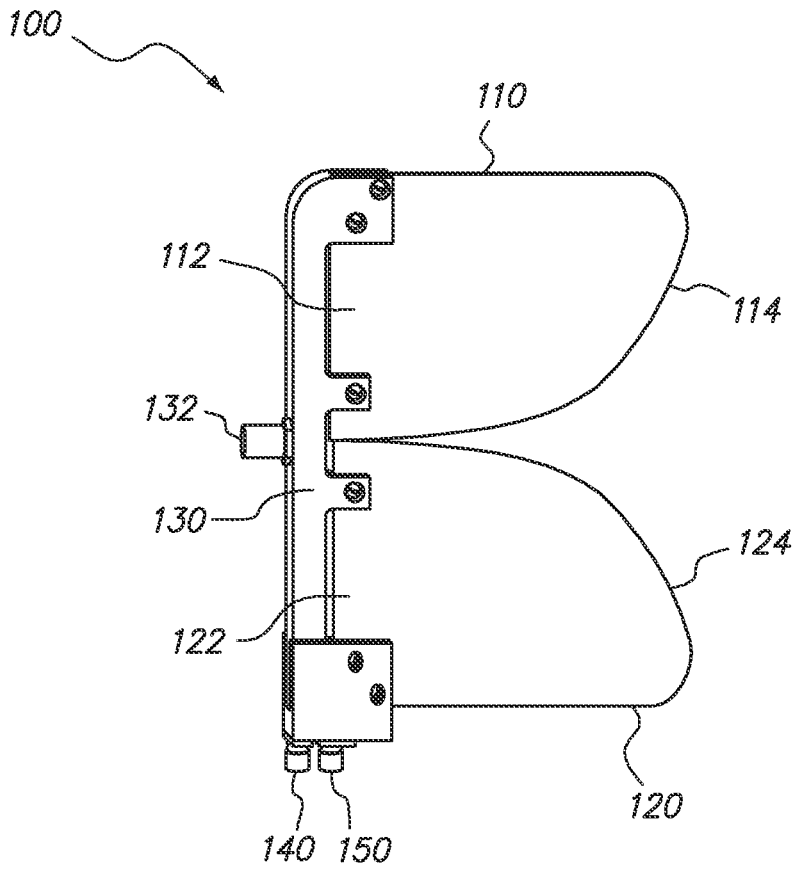
FIG. 3 shows a side view of an embodiment of an antenna pair of the Tapered Slot Antenna Hemispherical Array shown in FIG. 1.

As an example, base portion 20 may comprise a single cylindrical element or two hemi-cylindrical elements. However, other sizes, shapes, and configurations of base portion 20 may be used depending upon the size constraints and particular application of array 10. Base 20 may comprise a material configured to support plurality of TSA pairs 40 and 70. In one embodiment, base 20 comprises a substantially non-conductive material such as plastic and G10, wherein TSA pairs 40 and 70 directly connect to base 20. In one embodiment, base 20 comprises a substantially conductive material such as, for example, aluminum and steel, wherein plurality of TSA pairs 40 and 70 are operatively coupled to base 20 using a substantially non-conductive brace, such as shown in FIG. 3. As shown, base 20 is adapted to be operatively coupled to a cylindrical structure such as a ship mast or a pole mounted to a tall structure.

First plurality of TSA pairs 40 and second plurality of TSA pairs 70 each contain at least two TSA pairs. As an example, first plurality of TSA pairs 40 contains TSA pairs 42, 44, 46, 48, 50, and 52 and second plurality of TSA pairs 70 contains TSA pairs 72, 74, 76, 78, 80, and 82. In some embodiments, first plurality of TSA pairs 40 and/or second plurality of TSA pairs 70 contain fewer TSA pairs, while in other embodiments first plurality of TSA pairs 40 and/or second plurality of TSA pairs 70 contain more TSA pairs.

In some embodiments, the lengths of the antenna elements of TSA pairs 40 is equal to the lengths of the antenna elements of TSA pairs 70. In some embodiments, the lengths of the antenna elements of TSA pairs 40 is greater than or less than the lengths of the antenna elements of TSA pairs 70.

In some embodiments, the first plurality of TSA pairs 40 are electrically connected to the second plurality of TSA pairs 70. As an example, the electrical connection may be made using a combiner. In embodiments where first plurality of TSA pairs 40 are vertically aligned with second plurality of TSA pairs 70, each of the TSA pairs 40 and TSA pairs 70 that are vertically aligned are separately combined. For example, if as shown in FIGS. 2A and 2B, TSA pairs 46 and 76 were in vertical alignment they would be electrically combined, and so forth for the remainder of TSA pairs 40 and TSA pairs 70. In other embodiments, different electrical connections of TSA pairs 40 and TSA pairs 70 may be made. In embodiments wherein the electrical connection is made using combiners, the combiners may be connected to a radio frequency conditioning unit (RFCU) such as that disclosed in U.S. patent application Ser. No. 13/759,946, filed Feb. 5, 2013, entitled "Radio Frequency Conditioning Unit", to Brock et al.

FIG. 3 shows a side view of an embodiment of a TSA pair 100, such as TSA pair 42, 44, 46, 48, 50, 52, 72, 74, 76, 78, 80, or 82 as discussed above. TSA pair 100 includes two antenna elements 110 and 120 each having a feed end 112 and 122 oriented towards the support member 30 or 60 as shown in FIG. 1, and a launch end 114 and 124 oriented away from the support member 30 or 60. Feed ends 112 and 122 may be operatively coupled to an input/output (I/O) feed such as a coaxial cable. The I/O feed can be used to transmit and receive RF signals to and from the antenna array. RF signals can be transmitted from the feed end toward the launch end, wherein the RF signals launch from an antenna pair at a point between the feed end and the launch end depending upon the signal frequency. RF signals having higher frequencies launch closer to the feed end and RF signals having lower frequencies launch closer to the launch end.

The launch ends of each antenna element have curvatures represented by the equation $Y(x)=a(e^{bx}-1)$, wherein, a and b are parameters selected to produce a desired curvature, x is the length of the antenna element and Y is the height of the antenna element. As an example, a is approximately equal to 0.2801 and b is approximately equal to 0.1028, as mentioned in U.S. Pat. No. 7,009,572 entitled "Tapered Slot Antenna" to Horner et al., the entire content of which is incorporated herein by reference.

Antenna elements 110 and 120 are coupled to a brace 130, which is coupled to support member 30 or 60 by connector 132. As an example, brace 130 comprises a substantially non-conductive material such as plastic or G10. Antenna element 110 is fed by a feed line from feed port 140, while antenna element 120 is fed by a feed line from feed port 150. Antenna elements 110 and 120 may comprise a substantially conductive material such as, for example, stainless steel and aluminum. Elements 110 and 120 are configured to transmit and receive radio frequency (RF) energy.

Figure 4:
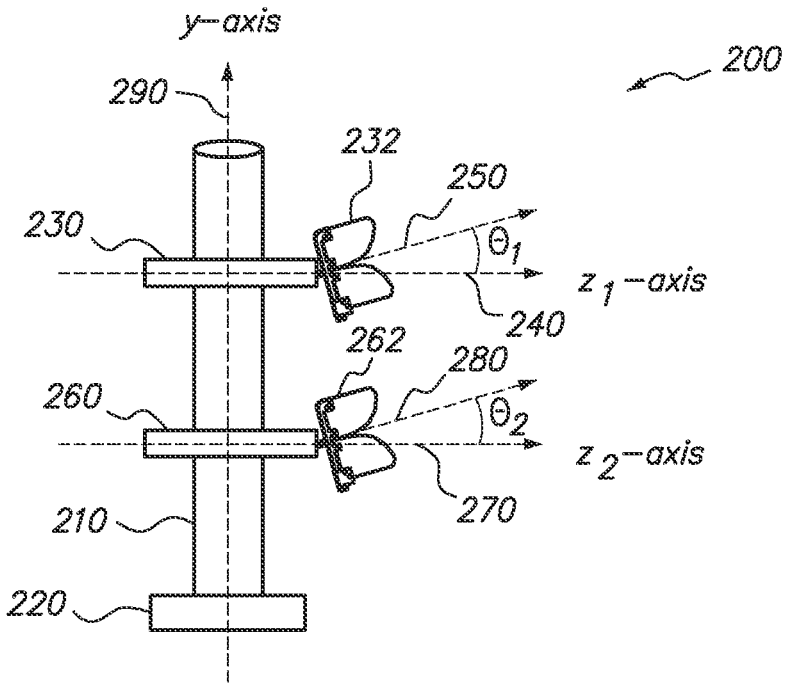
FIG. 4 shows a diagram depicting a partial side view of the Tapered Slot Antenna Hemispherical Array shown in FIG. 1.

FIG. 4 shows a diagram 200 depicting a partial side view of the Tapered Slot Antenna Hemispherical Array shown in FIG. 1. Diagram 200 includes a TSA hemispherical array having a base portion 210 and 220, a first support member 230 having a first TSA pair 232 coupled thereto, and a second support member 260 having a second TSA pair 262 coupled thereto. It should be noted that first support member 230 and second support member 260 have a plurality of TSA pairs coupled thereto as shown in FIG. 1, but only one is shown in FIG. 4 for illustration purposes.

TSA pairs 232 and 262 are each oriented at a non-zero angle, θ, about a first axis of the support member. For example, depending upon the frame of reference, the first axis may be a vertical axis or a horizontal axis. As shown, the first axis is an axis in the horizontal plane of support member 230 or 260. Thus, TSA pair 232 is oriented from an axis $z_1$ 240 at a non-zero angle, $\theta_1$, to an orientation along line 250, while TSA pair 262 is oriented from an axis $z_2$ 270 at a non-zero angle, $\theta_2$, to an orientation along line 280. The orientation at a non-zero angle about the first axis (i.e. axis $z_1$ and $z_2$) gives TSA pairs 232 and 262 an "elevation" with respect to their support member 230 or 260.

In some embodiments, TSA pairs 232 and 262 are oriented at the same angle with respect to their respective axis. In some embodiments, the TSA pair 232 is oriented at a greater angle with respect to the first axis of support member 230 than TSA pair 262 with respect to the first axis of support member 260, or vice versa. For example, TSA pairs 40 (as shown in FIG. 1) are elevated at an angle of between 30 degrees and 60 degrees, while TSA pairs 70 (as shown in FIG. 1) are elevated at an angle of between 5 degrees and 20 degrees.

Figure 5:
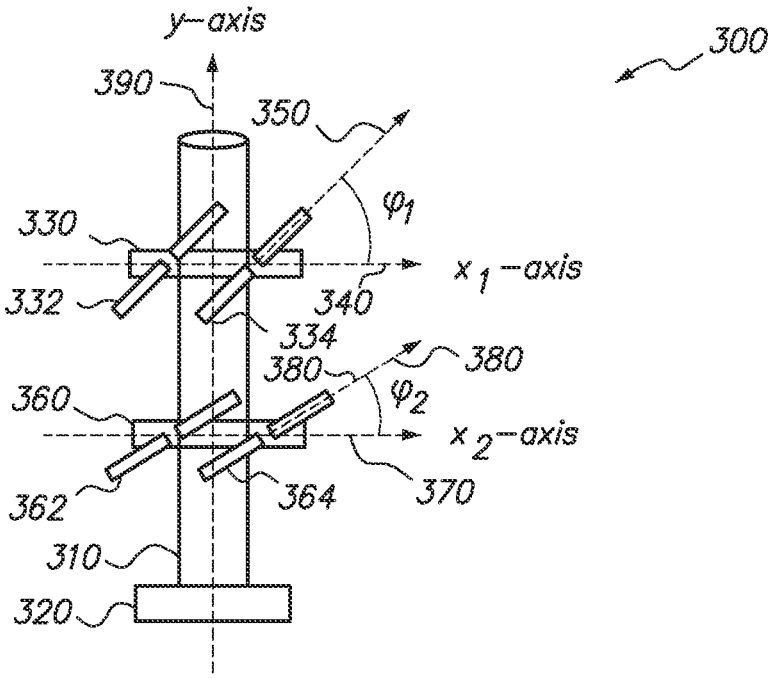
FIG. 5 shows a diagram depicting a partial front view of the Tapered Slot Antenna Hemispherical Array shown in FIG. 1.

FIG. 5 shows a diagram 300 depicting a partial side view of the Tapered Slot Antenna Hemispherical Array shown in FIG. 1. Diagram 300 includes a TSA hemispherical array having a base portion 310 and 320, a first support member 330 having a first TSA pairs 332 and 334 coupled thereto, and a second support member 360 having a second TSA pairs 362 and 364 coupled thereto. It should be noted that first support member 330 and second support member 360 have a plurality of TSA pairs coupled thereto as shown in FIG. 1, but only two are shown in FIG. 5 for illustration purposes.

TSA pairs 332 and 334 and 262 and 364 are each oriented at a non-zero angle, ϕ , about a first axis of their respective support member 330 or 360. For example, depending upon the frame of reference, the first axis may be a vertical axis or a horizontal axis. As shown, the first axis is an axis in the horizontal plane of support member 330 or 360. Thus, TSA pairs 332 and 334 are oriented from an axis $x_1$ 340 at a non-zero angle, $\phi_1$, to an orientation along line 350, while TSA pairs 362 and 364 are oriented from an axis $x_2$ 370 at a non-zero angle, $\phi_2$, to an orientation along line 380. The orientation at a non-zero angle about the first axis (i.e. axis $x_1$ and $x_2$) gives TSA pairs 332 and 334 and 362 and 364 a "tilt" with respect to their support member 330 or 360.

In some embodiments, TSA pairs 332 and 334 and 362 and 364 are oriented at the same angle with respect to their respective axis. In some embodiments, the TSA pairs 332 and 334 are oriented at a greater angle with respect to the first axis of support member 330 than TSA pairs 362 and 364 with respect to the first axis of support member 360, or vice versa. For example, TSA pairs 40 (as shown in FIG. 1) are tilted at an angle of between 30 degrees and 60 degrees, while TSA pairs 70 (as shown in FIG. 1) are tilted at an angle of between 5 degrees and 20 degrees.

In some embodiments, the TSA pairs are only elevated with respect to a first axis of their respective support member (as shown in FIG. 4). In some embodiments, the TSA pairs are only tilted with respect, to a first axis of their respective support member (as shown in FIG, 5). However, in some embodiments, the TSA pairs are tilted in addition to being elevated. As shown in FIG. 1, TSA pairs 40 and 70 may be both elevated at an angle with respect to a first axis (i.e. axis $z_1$ and $z_2$ shown in FIG. 4) and tilted at an angle with respect to a second axis (i.e. axis $x_1$ and $x_2$ shown in FIG. 5). In such embodiments, the first axis may be perpendicular to the second axis. In some embodiments, the first axis may be oriented at a non-perpendicular angle to the second axis. It should be noted that the particular angles of orientation may vary from zero degrees to ninety degrees depending upon the particular application and array design implemented.

Figure 6:
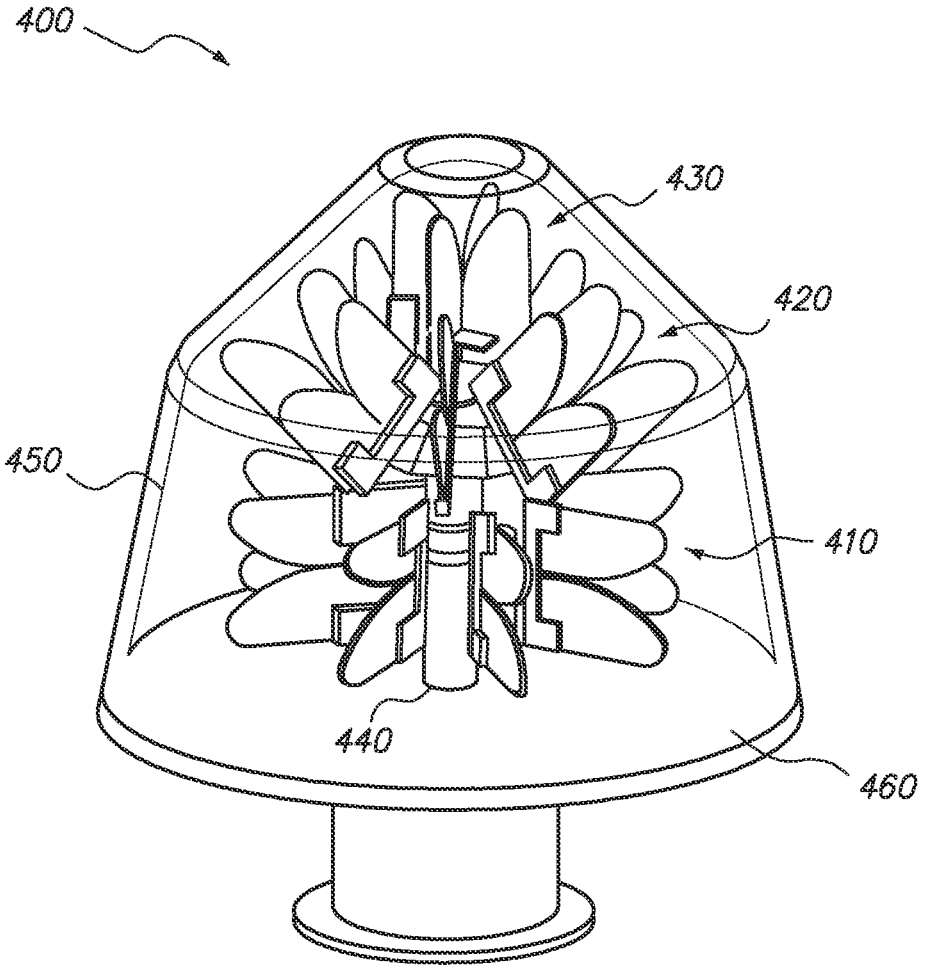
FIG. 6 shows a diagram of an embodiment of a Tapered Slot Antenna Hemispherical Array having three antenna arrays.

FIG. 6 shows a diagram of an embodiment 400 of a Tapered Slot Antenna Hemispherical Array. Array 400 includes a first array 410, a second array 420, and a third array 430, each connected to a support 440 and contained within a protective radome 450. As an example, radome 450 comprises dielectric material that substantially encapsulates each of antenna arrays 410, 420, and 430. In one embodiment, radome 450 substantially seals the antenna arrays from an external environment. In one embodiment, radome 450 is electrically transparent to all RF energy. In one embodiment, radome 450 is electrically transparent to a band of RF energy. In one embodiment, radome 450 comprises frequency selective surface material. In one embodiment, radome 450 comprises durable material. In one embodiment, radome 450 comprises fiberglass cloth with polyester resin.

Each of arrays 410, 420, and 430 may be angled at different elevations with respect to the horizontal support 460. For example, first array 410 may be oriented at a zero angle with respect to support 460, second array 420 may be oriented at a 45 degree angle with respect to support 460, and third array 430 may be oriented at a 90 degree angle with respect to support 460. A configuration such as that shown in FIG. 6 may be used to provide an antenna array with a hemispherical range of signal detection and reception capabilities.

Further, in some embodiments, the lengths of the antenna elements of first array 410, second array 420 and third array 430 are equal. In some embodiments, the lengths of the antenna elements of first array 410 are greater than or less than the lengths of the antenna elements of second array 420 and/or third array 430. In some embodiments, the lengths of the antenna elements of second array 420 are greater than or less than the lengths of the antenna elements of first array 410 and/or third array 430.

Figure 7:
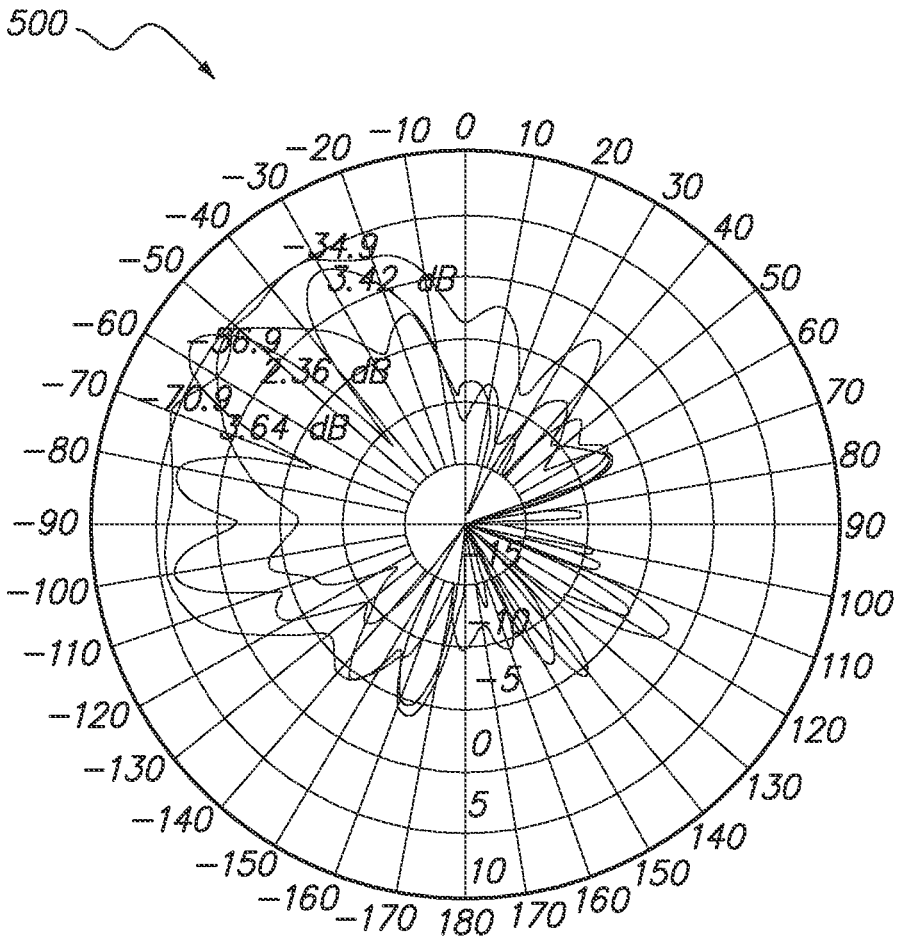
FIG. 7 shows an elevation polar plot showing the radiation pattern at 3.516 GHz for summed collinear upper and lower arrays for a Tapered Slot Antenna Hemispherical Array having two antenna arrays.
Figure 8:
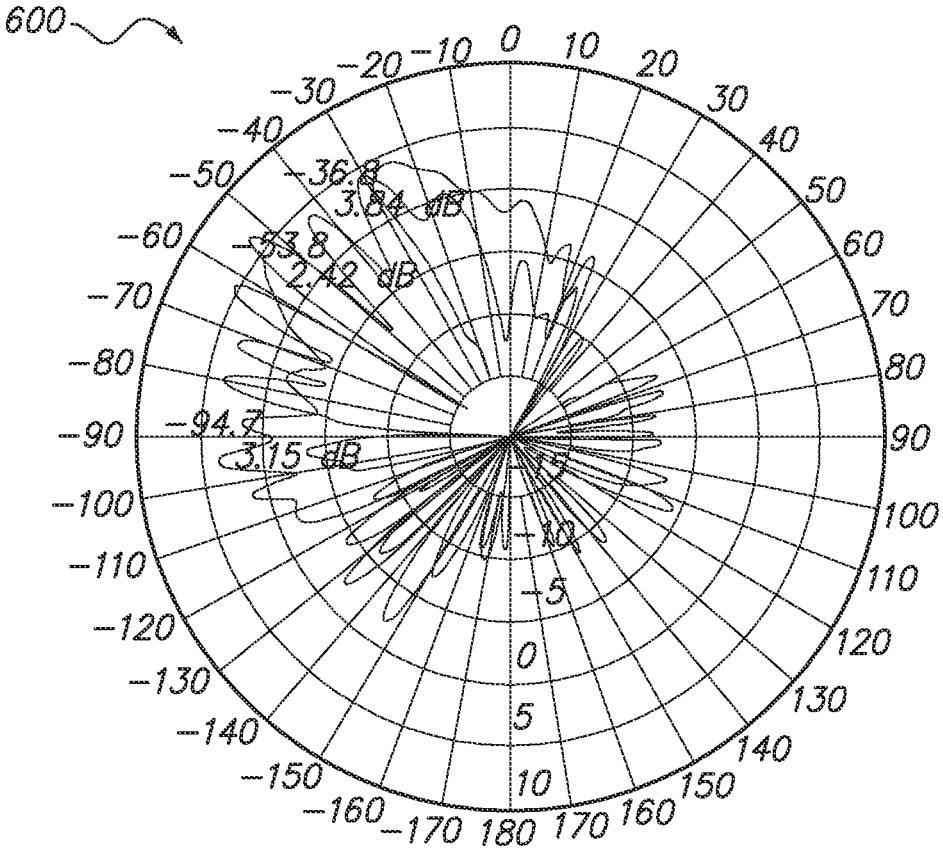
FIG. 8 shows an elevation polar plot showing the radiation pattern at 9.5 GHz for summed collinear upper and lower arrays for a Tapered Slot Antenna Hemispherical Array having two antenna arrays.
Figure 9:
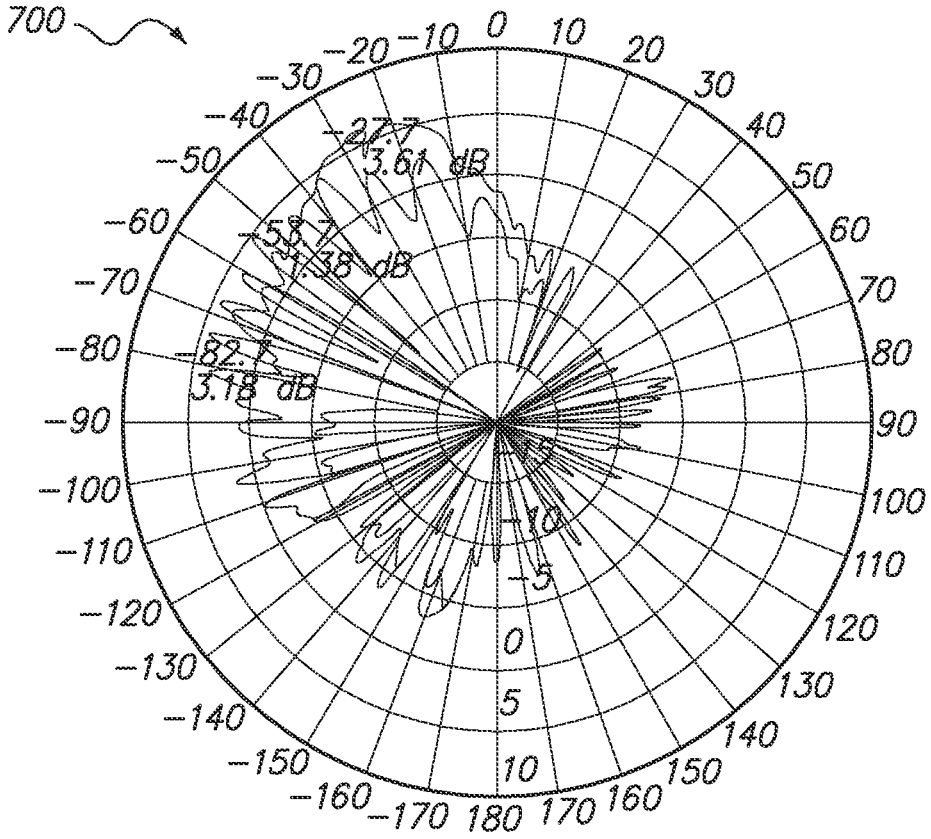
FIG. 9 shows an elevation polar plot showing the radiation pattern at 12.968 GHz for summed collinear upper and lower arrays for a Tapered Slot Antenna Hemispherical Array having two antenna arrays.
Figure 10:
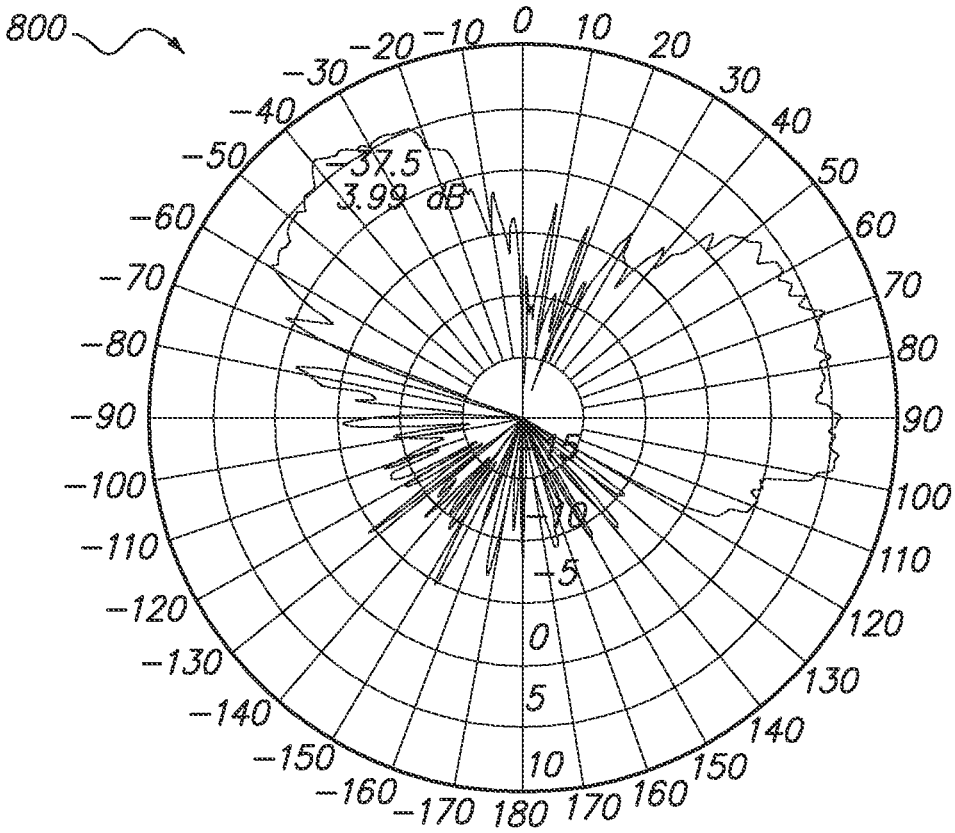
FIG. 10 shows an elevation polar plot showing the radiation pattern at 17.320 GHz for summed opposite upper and lower arrays for a Tapered Slot Antenna Hemispherical Array having two antenna arrays.

Referring to FIGS. 7-10, FIG. 7 shows an elevation polar plot 500 showing the radiation pattern at 3.516 GHz for summed collinear upper and lower arrays for a Tapered Slot Antenna Hemispherical Array having two antenna arrays, FIG. 8 shows an elevation polar plot 600 showing the radiation pattern at 9.5 GHz for summed collinear upper and lower arrays , FIG. 9 shows an elevation polar plot 700 showing the radiation pattern at 12.968 GHz for summed collinear upper and lower arrays , and FIG. 10 shows an elevation polar plot 800 showing the radiation pattern at 17.320 GHz for summed opposite upper and lower arrays.

FIGS. 7-10 show how the antenna gain/sensitivity changes with angle, particularly gain/sensitivity in elevation. The embodiments of the arrays discussed herein are able to hold that gain/sensitivity across a wide frequency range, whereas legacy antennas are typically narrow band or limited in frequency range.

As an example, FIG. 7 contains three different antenna patterns—one for the lower element, one for the upper element, and one for the combination of the upper element and the lower using a power combiner. At some frequencies, the combination pattern is very sporadic or scattered, which is undesirable. It is desirable for the combination to be very consistent (i.e. high gain) so there is good coverage regardless of elevation. Further, combining the elements as indicated in FIG. 10 provides less penalty in gain since there is no scalloping in the combined antenna pattern.

Many modifications and variations of the Tapered Slot Antenna Hemispherical Array are possible in light of the above description. Within the scope of the appended claims, the embodiments of the systems described herein may be practiced otherwise than as specifically described. The scope of the claims is not limited to the implementations and the embodiments disclosed herein, but extends to other implementations and embodiments as may be contemplated by those having ordinary skill in the art.

We claim:

1. A system comprising:

a support member; and a plurality of tapered slot antenna (TSA) pairs coupled to the support member, each TSA pair including two antenna elements each having a feed end oriented towards the support member and a launch end oriented away from the support member, wherein the TSA pairs are elevated at a non-zero angle about a first axis of the support member, wherein the first axis is in a horizontal plane of the support member.

2. The system of claim 1, wherein the launch ends of each antenna element have curvatures represented by the equation $Y(x)=a(e^{bx}-1)$, wherein, a and b are parameters selected to produce a desired curvature, x is the length of the antenna element and Y is the height of the antenna element.

3. The system of claim 1, wherein the TSA pairs are tilted at a non-zero angle about a second axis of the support member, wherein the second axis is perpendicular to the first axis.

4. The system of claim 1, wherein the plurality of TSA pairs are symmetrically couple about the support member.

5. The system of claim 1, wherein each TSA pair further includes a brace, wherein the antenna elements are coupled to the brace, wherein the brace is coupled to the support member.

6. The system of claim 1, wherein the support member is coupled to a base portion.

7. A system comprising:

a base portion;

a first support member coupled to the base portion on a first plane;

a first plurality of TSA pairs coupled to the first support member, each TSA pair of the first plurality including two first plurality antenna elements each having a feed end oriented towards the first support member and a launch end oriented away from the first support member, wherein the TSA pairs of the first plurality are oriented at a non-zero angle about a first axis of the first support member;

a second support member coupled to the base portion on a second plane; and a second plurality of TSA pairs coupled to the second support member, each TSA pair of the second plurality including two second plurality antenna elements each having a feed end oriented towards the second support member and a launch end oriented away from the second support member, wherein the TSA pairs of the second plurality are oriented at a non-zero angle about a first axis of the second support member.

8. The system of claim 7, wherein the non-zero angle about the first axis of the first support member is greater than the non-zero angle about the first axis of the second support member.

9. The system of claim 7, wherein the TSA pairs of the first plurality are further oriented at a non-zero angle about a second axis of the first support member, wherein the second axis of the first support member is perpendicular to the first axis of the first support member.

10. The system of claim 7, wherein the TSA pairs of the second plurality are further oriented at a non-zero angle about a second axis of the second support member, wherein the second axis of the second support member is perpendicular to the first axis of the second support member.

11. The system of claim 7, wherein the TSA pairs of the first plurality are further oriented at a non-zero angle about a second axis of the first support member, wherein the second axis of the first support member is perpendicular to the first axis of the first support member, wherein the TSA pairs of the second plurality are further oriented at a non-zero angle about a second axis of the second support member, wherein the second axis of the second support member is perpendicular to the first axis of the second support member.

12. The system of claim 11, wherein the non-zero angle about the second axis of the second support member is equal to the non-zero angle about the second axis of the first support member.

13. The system of claim 11, wherein the non-zero angle about the second axis of the second support member is greater than the non-zero angle about the second axis of the first support member.

14. The system of claim 7, wherein the number of the first plurality of antenna elements is equal to the number of the second plurality of antenna elements.

15. The system of claim 7, wherein each of the second plurality antenna elements has a length greater than the length of each of the first plurality antenna elements.

16. The system of claim 7, wherein each TSA pair of the first plurality and each TSA pair of the second plurality further includes a brace, wherein each antenna element is coupled to its respective brace, wherein each brace is coupled to its respective first support member or second support member.

17. A system comprising:

a base portion;

a first support member coupled to the base portion on a first plane;

a first plurality of TSA pairs coupled to the first support member, each TSA pair of the first plurality including two first plurality antenna elements each having a feed end oriented towards the first support member and a launch end oriented away from the first support member, wherein the TSA pairs of the first plurality are oriented at a non-zero angle about a first axis of the first support member;

a second support member coupled to the base portion on a second plane;

a second plurality of TSA pairs coupled to the second support member, each TSA pair of the second plurality including two second plurality antenna elements each having a feed end oriented towards the second support member and a launch end oriented away from the second support member, wherein the TSA pairs of the second plurality are oriented at a non-zero angle about a first axis of the second support member;

a third support ember coupled to the base portion on a third plane; and a third plurality of ISA pairs coupled to the third support member, each TSA pair of the third plurality including two third plurality antenna elements each having a feed end oriented towards the third support member and a launch end oriented away from the third support member, wherein the TSA pairs of the third plurality are oriented parallel with a vertical axis of the base portion.

18. The system of claim 17, wherein the TSA pairs of the first plurality are further oriented at a non-zero angle about a second axis of the first support member, wherein the second axis of the first support member is perpendicular to the first axis of the first support member, wherein the tapered slot antenna pairs of the second plurality are further oriented at a non-zero angle about a second axis of the second support member, wherein the second axis of the second support member is perpendicular to the first axis of the second support member.

19. The system of claim 17, wherein the number of the first plurality of antenna elements is equal to the number of the second plurality of antenna elements and greater than the number of the third plurality of antenna elements.

20. The system of claim 17, wherein each of the second plurality antenna elements has a length greater than the length of each of the first plurality antenna elements.

* * * * *